US009469521B2

(12) United States Patent
Laghi et al.

(10) Patent No.: US 9,469,521 B2
(45) Date of Patent: Oct. 18, 2016

(54) INDUCTION HEATING DEVICE FOR SHAVING AND COSMETIC APPLICATIONS

(71) Applicants: Aldo A. Laghi, Pinellas Park, FL (US); Eric Prast, St. Petersburg, FL (US); Nate Vint, Clearwater, FL (US)

(72) Inventors: Aldo A. Laghi, Pinellas Park, FL (US); Eric Prast, St. Petersburg, FL (US); Nate Vint, Clearwater, FL (US)

(73) Assignee: ALPS SOUTH EUROPE S.R.O., Bozkov (CZ)

( * ) Notice: Subject to any disclaimer, the term of this patent is extended or adjusted under 35 U.S.C. 154(b) by 234 days.

(21) Appl. No.: 14/341,696

(22) Filed: Jul. 25, 2014

(65) Prior Publication Data

US 2016/0023887 A1 Jan. 28, 2016

(51) Int. Cl.

| | |
|---|---|
| ***H05B 6/00*** | (2006.01) |
| ***H05B 6/10*** | (2006.01) |
| ***B67D 7/82*** | (2010.01) |
| ***B05B 9/00*** | (2006.01) |

(52) U.S. Cl.

CPC ..... *B67D 7/82* (2013.01); *B05B 9/002* (2013.01); *H05B 6/105* (2013.01); *A45D 2200/155* (2013.01)

(58) Field of Classification Search

CPC ..... H05B 9/002; H05B 6/02; H05B 6/802; H05B 6/42; H05B 6/108; H05B 6/62; H05B 6/062; H05B 6/105; A45D 27/00; A45D 2200/155

USPC ..... 219/214, 634, 618, 625, 628, 635; 222/146.5, 146.2

See application file for complete search history.

(56) References Cited

U.S. PATENT DOCUMENTS

| | | | | |
|---|---|---|---|---|
| 2,867,347 | A | 1/1959 | Champagnat | |
| 2005/0011883 | A1* | 1/2005 | Clothier | F28D 20/0056 219/618 |
| 2008/0257880 | A1 | 10/2008 | Brown et al. | |
| 2011/0200381 | A1 | 8/2011 | Bylsma et al. | |

* cited by examiner

*Primary Examiner* — Hung D Nguyen
(74) *Attorney, Agent, or Firm* — GrayRobinson, P.A.

(57) ABSTRACT

A dispenser for dispensing warmed shaving and cosmetic products having an induction heating system mounted within housing for heating only a conductive floating target screen disposed on an upper surface region of a shaving or cosmetic product stored within a product receptacle surrounded by an induction heating coil of the induction heating system thereby heating only the upper surface region of the product.

15 Claims, 6 Drawing Sheets

INDUCTION HEATING DEVICE FOR SHAVING AND COSMETIC APPLICATIONS

CROSS-REFERENCE TO RELATED APPLICATIONS

Not applicable.

STATEMENT REGARDING FEDERALLY SPONSORED RESEARCH OF DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

Basic principles of induction heating date back to Michael Faraday's work in 1831. Induction heating is the process of heating an electrically conductive object by electromagnetic induction, where eddy currents are generated within the metal and resistance leads to Joule heating of the metal. This technology is widely used in industrial welding, brazing, bending, and sealing processes. Also, induction heating has grown very popular in culinary applications, providing a more efficient and accelerated heating of liquids and/or foods on stovetops or in ovens. Advantages of using an induction heating system are an increase in efficiency using less energy and also applying direct heat to a specific target.

Applying heated shaving cream or cleansing gel to the skin opens pores translating in a more comfortable shave or a more effective skin cleansing. Currently the process of heating shaving cream to the desired temperature is difficult. It requires meticulous attention and practice. Overheating can ruin the product and under-heating does not generate the desired effect. The technology available to heat shaving cream often requires shaving cream to be in an aerosol dispensed can. An aerosol based shaving cream is often times of poor quality. These shaving cans are often destroyed by repeated process of heating, and also unevenly heat the product. Resistance heating of the can is also extremely inefficient and causes the shaving can to remain hot for long periods after use.

One attempt of using an induction heating system is disclosed by Brown, et al. in US 20080257880 A1. Brown, et al. disclose an induction heating dispenser having a refill unit 8 heated by primary and secondary induction coils 2 and 13. As disclosed in paragraph [0020], the dispenser can be used for many different applications such as air fresheners, depilatory waxes, insecticides, stain removal products, cleaning materials, creams and oils for applications to the skin or hair, shaving products, shoe polish, furniture polish, etc. The refill unit 8 comprises a multiplicity of replaceable containers 9 for holding the respective products. The containers are sealed under a porous membrane 11. As disclosed in paragraph [0011], the porous membrane is usually removed for meltable solid substances. For volatile liquid substances, the porous membrane is not removed. As disclosed in paragraph [0023], the porous membrane 11 has a porosity that allows vapor to pass through but not liquid to prevent spillage. Also, in paragraph [0020], for heated products that are applied to a surface, the container may have an associated applicator such as a brush, pad or sponge.

Another heated dispenser system is disclosed by Bylsma, et al. in US 20110200381 A1. Bylsma, et al. disclose a dispenser wherein the heating unit could be either in the base unit 10 as illustrated in FIG. 4, or in the applicator 42 as illustrated in FIG. 5. As disclosed in paragraph [0026], the heating unit may be an inductive power coupling. As disclosed in paragraphs [0030-0036], the applicator may be of many different forms depending on the product to be dispensed.

Although the prior art systems have proven to be quite useful for their purposes, none have been designed to be energy efficient or to heat and/or melt only the amount of composition necessary for the immediate application as accomplished by the present invention.

BRIEF SUMMARY OF THE INVENTION

The present invention relates generally to a dispenser for products such as soaps, creams, lotions, gel compositions or other solutions (hereinafter "products") for shaving purposes or cosmetic purposes such as skin cleansing. The products are stored in a container wherein only the upper surface or region of the products is heated and/or melted by an induction heating device.

The present invention is an induction heating device capable of warming and/or melting, and warming and/or liquefying an upper surface region of the products. The device provides a non-contact heating system for the products. The device includes an induction receptacle which accepts a cup filled with a product wherein only the upper surface region of the product is heated. Inside the cup, a floating conductive porous screen is disposed across the upper surface of the product and is excited by electromagnetic induction and transfers heat to the top surface of the product. As the top surface of the product is heated and/or melted, an applicator such as a shaving brush or skin pad can be used to collect the heated and/or melted product from the upper surface of the floating screen which can be applied to the face or any other desired location of the body. The present invention is a more effective means of heating the product, especially for an amount necessary for the immediate application since only the upper surface or region is heated and/or melted. The cups of product are easily accessible and interchangeable from the receptacle. The present invention has no open flame, operates silently, and stays cool after the cup is removed. Furthermore, the product will return to its original form (e.g., solid, cream or gel) more quickly than if the entire product was melted.

BRIEF DESCRIPTIONS OF THE SEVERAL VIEWS OF THE DRAWING(S)

DETAILED DESCRIPTION OF THE INVENTION

Figure 1:
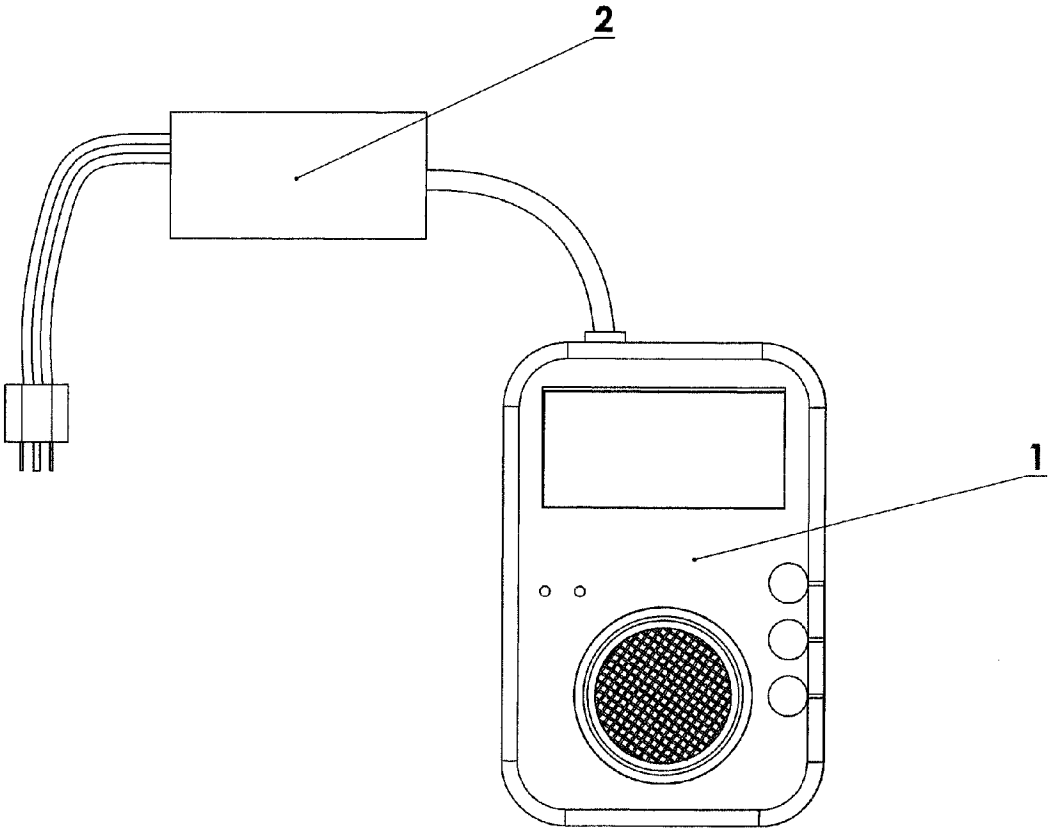
FIG. 1 is a perspective view of the induction heating system of the present invention.

The present invention as illustrated in FIG. 1 includes an induction heating unit (1) connected to an AC power supply and governed by an AC-DC regulator (2).

Figure 2:
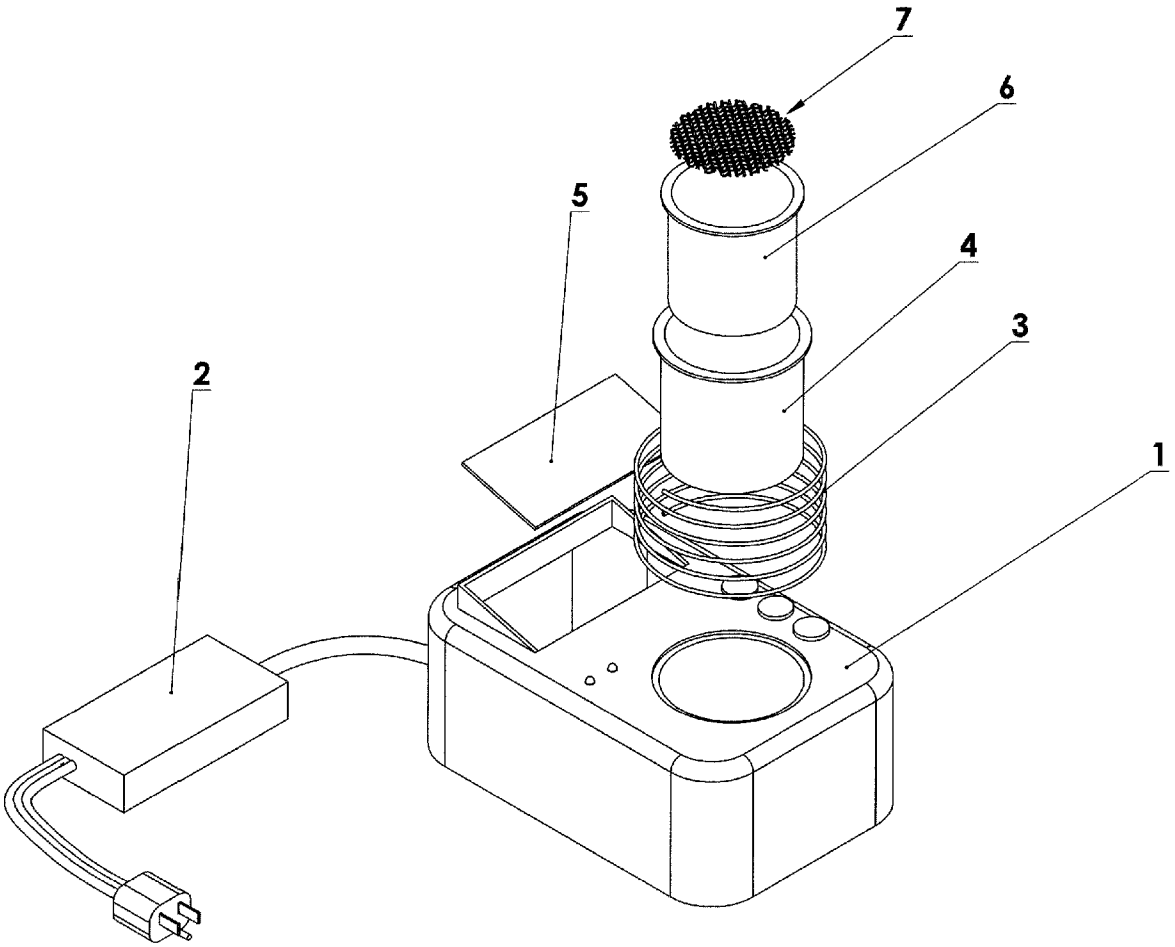
FIG. 2 is an exploded view of the present invention.

Referring to FIG. 2, an exploded view of the present invention is illustrated which includes a main housing having a top surface (1) with power supply (2). Disposed inside housing, an induction heating coil (3) surrounds receptacle (4). A product cup (6) is removably inserted within receptacle (4). A conductive target floating screen (7) is removably inserted within product cup (6) adapted to float on the upper surface of the product within the cup. By using the terminology "conductive target floating screen" herein is meant that it is the only element within the product cup (6) that is heated by the induction heating coil (3). It is also emphasized that the heated target screen (7) heats and/or melts the upper surface region of the product within the product cup (6). The product is not heated directly by the induction heater coil (3). Also shown is operator interface or user interface window (5) which allows the user to interact with the device through visual and touch based actions.

Figure 4B:
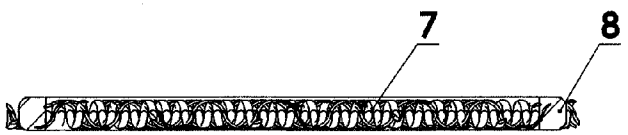
FIG. 4B is a cross-sectional view along the lines A-A shown in FIG. 4A.
Figure 3B:
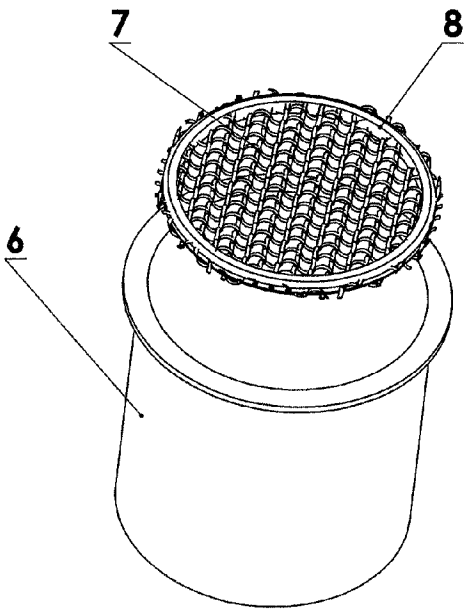
FIGS. 3A and 3B are perspective views of the cup and floatable screen of the present invention.
Figure 4A:
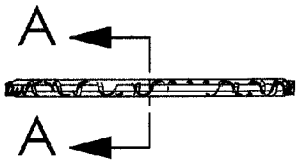
FIG. 4A is a side view of the floating screen.
Figure 3A:
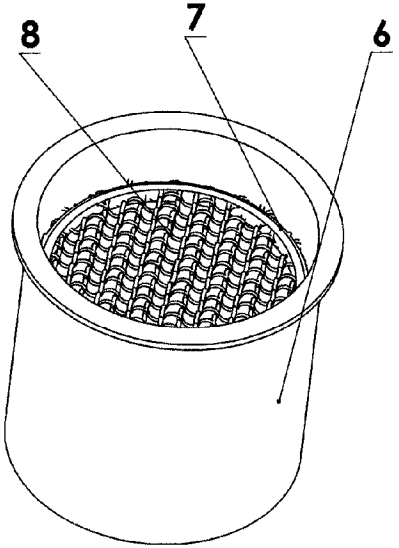

Referring to FIGS. 3A, 3B, 4A and 4B, product cup (6) contains product that are to be heated by the conductive target screen (7). The screen made of a conductive semi porous material. The preferred embodiment is a porous conductive mesh. This screen sits on top of the product to be heated and localizes heat energy to the top layer of the product. As the top layer of the product is heated and/or melted, the liquefied product flows through the screen to the top surface of the screen from which it is transferred to an applicator such as a shaving brush or skin pad. A floatation device (8) surrounds the edge of the screen in order to prevent the screen from sinking into the material during liquefaction of the upper region of the product. The floatation device may be constructed out of buoyant materials or may contain an air pocket. The edges of the screen can be attached to the floatation device in any conventional manner such as by molding techniques, adhesives, mechanical attachments or fusion welding, etc. FIG. 4B is a cross-sectional view along the lines A-A shown in FIG. 4A. The floatation device (8) and target screen (7) have collinear upper and lower surfaces. However, the configuration shown in FIG. 4B is not intended to be so limiting since any modified configuration of that shown in FIG. 4B is intended to lie within the scope of the present invention. For example, the floatation device and target screen may not have collinear upper and lower surfaces. As long as the floatation device maintains the target screen proximate to the upper surface region of the product, any configuration will be adequate.

Figure 5B:
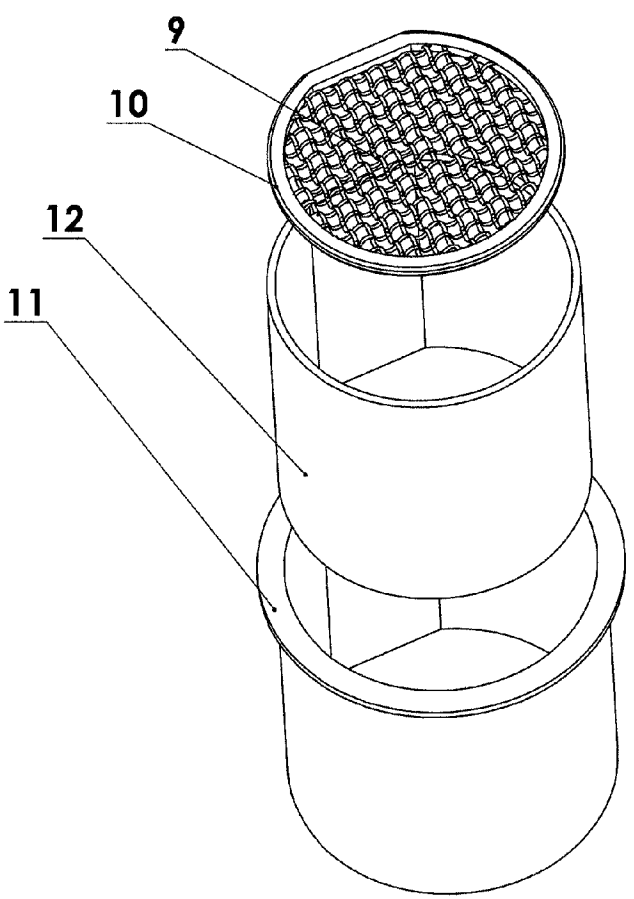
FIG. 5B is an exploded view of the modified receptacle, cup and floating screen of the present invention.
Figure 5A:
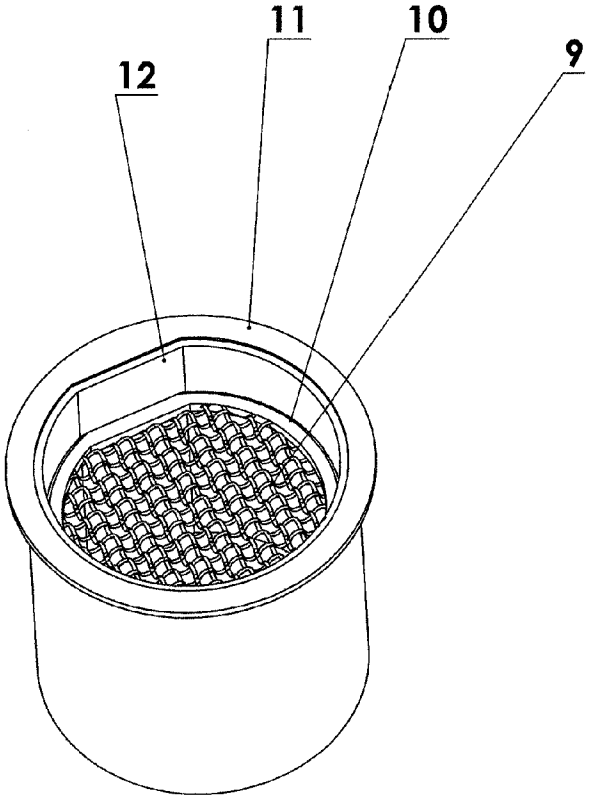
FIG. 5A is a perspective view of a modified assembled receptacle, cup and floating screen of the present invention.

Referring to FIGS. 5A and 5B, a conductive target screen (9) and floatation device (10) is removably inserted within product cup (12) which is removably inserted within receptacle (11). These components are similar to those shown in FIGS. 3A and 3B, but are modified with a non-circular geometry. In particular, each component has at least one flat surface for aligning the components in assembled position and preventing rotation while collecting the product onto the applicator. Although this embodiment is shown to have flat surfaces, any other configuration could be employed to align and prevent rotation of the components during use.

Figure 6:
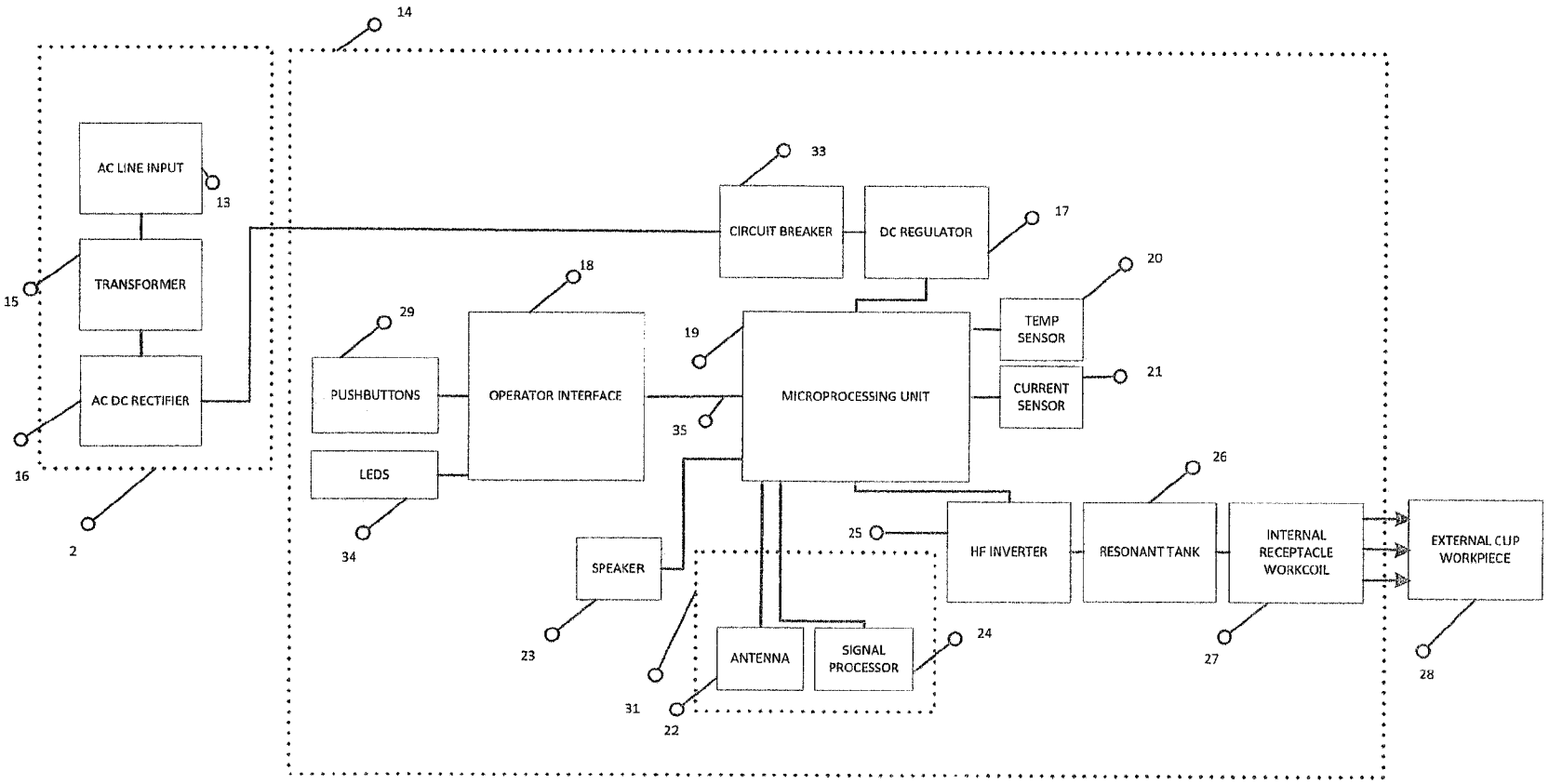
FIG. 6 is a block diagram of the components of the internal inductive heating electronic system of the present invention.

Referring to FIG. 6, a block diagram of the control system of the present invention is illustrated. A standard wall outlet AC line input (13), a standard electromagnetic transformer (15), and AC to DC rectifier (16) is provided to power the electromechanical components enclosed within a housing indicated by dotted line (2) which provides power to the main housing (14), which is shown as component (1) in FIGS. 1 and 2. The system further includes a standard IC regulator chip (17) that lowers the voltage to power the sensitive digital components. An operator interface (18) is accessed by window (5) shown in FIG. 2. A microprocessor unit (19) controls level of electromagnetic energy in the resonant tank (26), internal receptacle workcoil (27), and conductive screen (7). This in turn varies the level of heat energy induced into the conductive screen (7). The microprocessor (19) accomplishes this by adjusting the oscillation frequency in the HF converter (25) by means of pulse width modulation (PWM). The microprocessor (19) also controls the operator interface (18), temperature sensor (20), current sensor (21), antenna (22) and electro-acoustic transducer (23). The temperature sensor (20) is capable of reading the internal board component temperatures of the microprocessor as well as the temperatures of the receptacle windings workcoil. The current sensor (21) is configured to measure the current draw through the switching circuit within the microprocessor. The antenna (22) which can be any conventional type, such as a dipole, helical, periodic, loop, etc., is configured to receive information from remote modules or transmit data to an external remote control device, for example, via Bluetooth technology. The electro-acoustic transducer (23) can be any conventional type, such as a speaker, capable of producing warnings such as over-heating temperatures or other helpful aids to the user throughout the heat cycle. It may also provide instructions during the product application. The transducer may also be configured in such a manner that it records electrical-mechanical pulses and is read by a signal processor (24). The signal processor (24) is a standard signal processing unit used to decode information received from the antenna (22) and transmit information via the electro-acoustic transducer 23. The HF inverter (25) converts DC power to high frequency AC by means of receiving pulse width modulated signals from the microprocessor (19) and receiving high levels of DC power from rectifier (16). The high frequency AC generated by inverter (25) is then passed into a series, parallel, quasi-series, or quasi-parallel resistor, capacitor, and inductor network called a Resonant Tank (26). Tank (26) has a resonant frequency determined by the resistor, inductor, and capacitor (RLC) configuration therein. As current passes through the resonant tank (26), it travels through a large wound conductive copper coil (27) which is shown as element (3) in FIG. 2. The Resonant Tank (26) frequency is optimized through means of electrical reprogramming and tuning carried out by the microprocessor (19) and high frequency inverter (25). This system allows the device to deliver precise amounts of current into the internal receptacle workcoil (indicated as (27) if FIGS. 6 and (3) in FIG. 2) to heat the external cup workpiece (indicated as (28) in FIG. 6 and as "conductive target floating screen" (7) in FIG. 2), which also limits the system from overheating the various components of the system.

During the heat cycle and during non-heating idle time the microprocessor (19) monitors the current sensor (21) and temperature sensors (20) to ensure safe operation of the device. The coil is not visible to the outside of housing (1) and surrounds receptacle (4) and nested product cup (6) with target screen (7) resting on the top surface product within cup (6). Thus, the target screen (7) is closely coupled to the coil (27) which creates an electromagnetic field that passes electromagnetic energy into the external cup workpiece (28) which is the conductive target screen (7) shown in FIG. 2. By this process, the target screen only is heated by the electromagnetic energy which is then transferred to the upper surface of the product within the cup.

Figure 7:
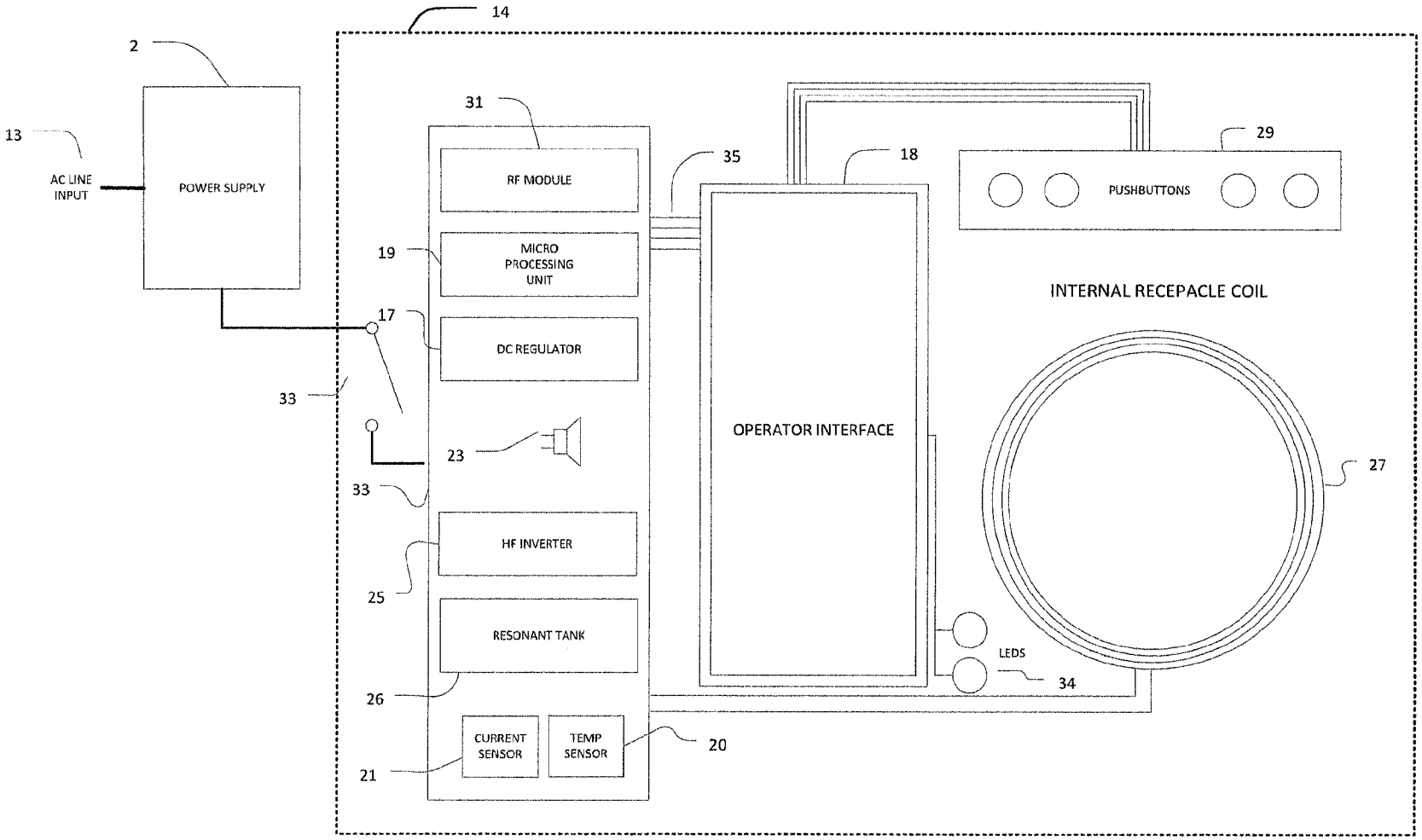
FIG. 7 is a perspective view of the actual arrangement of components within outer housing 14 of then present invention.

Referring to FIG. 7, a perspective view of how the components illustrated in FIG. 6 are arranged in main housing 14. The RF module (31), which comprises the antenna (22) and signal processor (24) seen in FIG. 6, microprocessing unit (19), DC regulator (17), HF converter (25), resonant tank (26), speaker (23), current sensor (21), and temperature sensor (20) are mounted on a main board (32). Power is fed in from a standard electrical wall outlet mains AC at (13). Power fed in is received by power supply (2) which includes transformer (15) and AC-DC rectifier (16) where it is converted into DC power and sent to the remaining components via the DC regulator (17), located on the main board (32). A circuit breaker (33) is utilized as a safety fault in the event of a large current consumption by the device. The operator interface (18) connects into the main board by means of a multi-conductor cable harness (35). On the main board (32), an RF module (31) contains the antenna (22) and signal processor (24). The RF module (31) transmits and receives information through antenna (22). Data received and sent passes through a signal processing unit (24) during read and write cycles of the communication buffer. The main board is controlled by microprocessing unit (19). Low voltage DC power is converted from high voltage DC by means of a DC regulator IC chip (17) located on the main board (32).

Operation of the electromechanical system of the present invention is a follows. First power is received by connecting (13), mains line AC power into the device with a plug. Voltage received is then electromagnetically reduced by transformer (15) and converted into direct current (DC) waveform by rectifier (16). Transformer (15) and rectifier (16) may be packaged together externally in an AC to DC power supply commonly used by computers or electronic devices. Inside the device the rectified DC power is passed through DC regulator (17), a monolithic integrated circuit regulator that step down the voltage to TTL, CMOS, ECL levels etc. The induction heater coil (3) is controlled by the microprocessor (19), which controls the timing and frequency of the HF inverter (25), sensors (20), (21), operator interface (18), led lights (34), timers, antenna (22), and speaker (23). It may be used to interact with many other device peripherals if needed. The microprocessor is programmed to control and vary the oscillation frequency in order to reach electromagnetic resonance between the workpiece, i.e., the screen, and the resonant tank. The microprocessor has flash memory read-while-write capabilities and EEPROM storage used in order to store user settings, timers, and safeties. Users are able to interact with the device by visually watching or pressing the operator interface (18) or user pushbuttons (29). Display of operator interface (18) is constructed of a piezoresistive, capacitive, surface acoustic, infrared grid or similar technologies. It allows the user to press and start a heating cycle while displaying helpful information based on the temperature or duration of the cycle. Safety information can be depicted on this display or any other helpful visual aids. In addition to operator interface (18), a speaker (23) is used to provide audible feedback and alerts to the user based on the state of the heat cycle. The pushbuttons (29) are used as a secondary source of user input. Nearby LEDs (34) are used to provide a secondary visual indication of the state of the device. Pushbuttons, LEDs, and the Operator Interface may be reprogrammed by the manufacturer in order to adjust the functionality and usability throughout different device revisions. Once a heat cycle is initiated, the microprocessor (19) inputs a low voltage pulse width modulated (PWM) signal received by the high frequency (HF) inverter module (25). The inverter module switches the rectified DC power from rectifier (16) to HF alternating current power at the oscillation frequency set by the microprocessor (19). High frequency AC power is then passed into a series or parallel resonant RLC tank. The tanks capacitance, inductance, and resistance are optimized to reach the resonant frequency of the PWM signal. This resonance also matches the oscillation frequency of the screen (7 or 9). Throughout the heat cycle, current transferred into screen (7 or 9) is measured by sensor (21). At this time, microprocessor (19) adjusts the oscillation frequency in order to transfer maximum power into screen (7 or 9). If the current exceeds a safety limit measured by sensor (21), the device shuts off the heat cycle. Likewise, the temperature of the internal components is measured by sensor (20). This prevents the device from being left on throughout the day or operating in harsh environments. Sensor (20) also measures the internal coil (3) temperature to prevent overheating on its internal windings. During the heat cycle high frequency currents are passed through the resonant tank (26) and into the coil (3) wrapped around a receptacle (4 or 11) that receives the cup (6 or 12). The high frequency currents are then transferred to screen (7 or 9) through means of electromagnetic induction. Eddy currents are generated inside screen (7 or 9) and cause a Joule heating effect as well as a heating through magnetic hysteresis. Heat generated through screen (7 or 9) then permeates through to the top layer of the product inside the cup. Due to the geometry of the screen (7 or 9), energy is transferred more directly to the top layer of the product inside cup (6 or 12).

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the invention and are thus within the spirit and scope of the present invention. In addition, all publications and patent documents referenced herein are incorporated herein by reference in their entireties.

What is claimed is:

1. An induction heating device adapted to heat products for shaving or cosmetic purposes comprising:

a housing having a product receptacle for holding products for shaving or cosmetic purposes, said product defining an upper surface region in said product receptacle;

an induction coil surrounding said product receptacle for generating electromagnetic energy into said product receptacle;

electronic circuitry connected to said induction coil for activating said coil to generate said electromagnetic energy; and a conductive target floating screen in said product receptacle sized to overlie said upper surface region and adapted to float on said upper surface region of said product;

whereby said conductive target floating screen is heated by electromagnetic induction thereby heating only said upper surface region of said product for application to a user.

2. The induction heating device as claimed in claim 1 and further comprising:

said housing includes a top surface;

said product receptacle includes a first cylindrical shaped cup mounted in said top surface and a second cylindrical shaped cup removably inserted in said first cylindrical shaped cup, said second cylindrical shaped cup is adapted to hold said products for shaving or cosmetic purposes.

3. The induction heating device as claimed in claim 2, wherein said second cylindrical shaped cup is complementally configured to said first cylindrical shaped cup.

4. The induction heating device as claimed in claim 3, wherein said first and second cylindrical shaped cups are configured to maintain alignment and prevent rotation therebetween during use.

5. The induction heating device as claimed in claim 4, wherein said first and second cylindrical shaped cups have flat sidewall sections to maintain alignment and prevent rotation therebetween during use.

6. The induction heating device as claimed in claim 1, wherein said conductive target floating screen comprises a conductive screen having a peripheral edge surrounded by and attached to a float member.

7. The induction heating device as claimed in claim 6, wherein said float member comprises solid or hollow buoyant material.

8. The induction heating device as claimed in claim 1, wherein said induction heating device includes a power supply unit receiving alternating current or direct current sources.

9. The induction heating device as claimed in claim 8, wherein said electronic circuitry is mounted in said housing and includes means for generating high frequency electromagnetic energy and inducing power into to the conductive target floating screen, said electronic circuitry regulates the high frequency alternating current to modulate the heat generated inside said conductive target floating screen.

10. The induction heating device as claimed in claim 9, wherein said means comprises a microprocessor, high frequency inverter circuit, resonant tank circuit and said induction coil.

11. The induction heating device as claimed in claim 10, further comprising an operator interface connected to said microprocessor for permitting the user to press and start and stop a heating cycle, adjusting the energy level and duration of heat of a heating cycle, and displaying helpful information based on the energy level, temperature, or duration of the heating cycle.

12. The induction heating device as claimed in claim 11, further comprising current and temperature sensors for monitoring current and temperatures of the electronic circuitry.

13. The induction heating device as claimed in claim 12, further comprising visual and/or acoustical alarm means responsive to said current and temperature sensors for indicating over-currents or over-heating temperatures of the electronic circuitry.

14. The induction heating device as claimed in claim 11, further comprising an RF module for transmitting and receiving information to and from said microprocessor for controlling said heating device or other cosmetic wireless peripherals via a remote control device.

15. The induction heating device as claimed in claim 14, further comprising a speaker for transmitting said information.

* * * * *